United States Patent [19]

Terwel

[11] Patent Number: 4,984,615

[45] Date of Patent: Jan. 15, 1991

[54] METHOD AND DEVICE FOR CUTTING A SANDWICH PANEL

[75] Inventor: Roelof Terwel, Ommen, Netherlands

[73] Assignee: 501 Sallmetall BV, Raalte, Netherlands

[21] Appl. No.: 388,603

[22] Filed: Aug. 1, 1989

[30] Foreign Application Priority Data

Aug. 3, 1988 [NL] Netherlands ..... 8801939

[51] Int. Cl.[5] ..... B27M 1/08; B27M 1/00

[52] U.S. Cl. ..... 144/367; 83/875; 83/879; 144/3 R; 144/41; 144/103; 144/136.12; 144/371

[58] Field of Search ..... 144/3 R, 1 R, 2 R, 41, 144/182, 183, 136 R, 371, 193 R; 83/875, 879

[56] References Cited

U.S. PATENT DOCUMENTS

| | | | |
|---|---|---|---|
| 3,421,556 | 1/1969 | Clifford | 144/3 |
| 3,605,534 | 9/1974 | Barr | 83/875 |
| 4,083,390 | 4/1978 | Ingham | 144/136 R |
| 4,181,164 | 1/1980 | Meniconi | 144/41 |
| 4,342,349 | 8/1982 | Lipman | 144/136 R |
| 4,798,118 | 1/1989 | Carithers, Jr. | 144/126 R |

FOREIGN PATENT DOCUMENTS

| | | |
|---|---|---|
| 0251090 | 1/1988 | European Pat. Off. . |
| 1555795 | 12/1968 | France . |
| 7110805 | 8/1971 | Netherlands . |

*Primary Examiner*—W. Donald Bray

*Attorney, Agent, or Firm*—Willian, Brinks, Olds, Hofer, Gilson & Lione

[57] ABSTRACT

A method and device for making a completely smooth cut in a sandwich panel constructed of a core having two relatively thin and mechanically resistant skin plates adhered thereto on both sides. The disclosed method using the steps of cutting a channel in at least one of the skin plates and cutting the core with another blade through the previously cut channel.

16 Claims, 6 Drawing Sheets

METHOD AND DEVICE FOR CUTTING A SANDWICH PANEL

The invention relates to a method for making a cut in a sandwich panel consisting of a core and relatively thin and mechanically resistent skin plates adhered thereto on both sides, which includes the following steps:

(1) the provision of a sandwich panel, (2) the provision of a first knife with a blade sufficiently long to make a cut in the panel, (3) the setting into operation of the first knife in relative position parallel to the main plane of the panel for making the cut in the panel along a preselected path.

By "mechanically resistent" should be understood a material of great stiffness and mechanical strength relative to the core, which is constructed for example of foam rubber. The skin plates can be constructed from plastic, hard cardboard or other suitable materials and may optionally be provided with a covering layer via a double-sided adhesive foil or via glue.

Such lightweight sandwich panels are suitable for many purposes, for instance as construction panels, wall systems or panels for affixing especially larger photos, for example for exhibitions.

When such panels are sawn, using for example a circular saw machine, considerable formation of dust cannot be prevented. For use in photographic laboratories the use of Gatorfoam® can be considered, a product registered by International Paper Company Uniwood Division, P.0. Box 5380, Statesville, N.C. 28677.

The cutting of such Gatorfoam or GF panels can, as far as applicant is aware, be performed manually only with great skill. The hardness and stiffness of the skin plates make it difficult however to realize a straight and qualitatively acceptable cut by hand. A problem in cutting is that during the cutting the edges of the skin plates break away as a result of the great sidelong forces exerted through the wedging action of the knife. Such an irregular edge is unacceptable for high quality panels.

The invention now offers a method which ensures a completely smooth cut, and this with simple means. To this end the method according to the invention is characterized by the following step:

(4) the forming prior to step (3) of a free zone extending along the chosen path, in which zone the first skin plate to be directed to the knife is removed and which zone is at least as wide as the blade.

A preferred embodiment of the method according to the invention displays the feature that step (4) is performed by:

(5) providing a second and third knife with a blade of sufficient length for cutting at selected angles through the first skin plate to be directed to the first knife and for cutting into the core up to a chosen depth, and (6) successive setting into operation of the second and third knives parallel to the main plane of the panel along paths parallel to the chosen path, with a slanted positioning of the second knife and the third knife such that a wedge-shaped zone is cut out, of which the width on the transition between the core and the first skin plate corresponds with the width of the said free zone.

The slanted positioning of the knives serves to ensure that, prior to cutting through of the panel by means of the first knife, the material situated on the outside adjacent to the formed cut can deflect outward. Were use to be made of a cut in a skin plate that was perpendicular to the plate, the material of this skin plate adjacent to the formed cut cannot deflect, with the result that undesired and uncontrollable stresses can occur which may cause breaking off of the material of the skin plate adjacent to the cut. The said slanted position is therefore essential for the forming of an exact, smooth cut edge. For the same reason therefore the one slanting cut has to be formed first with the one knife, only then to be followed by the forming of the second cut with the other knife in order to form the wedge-shaped cut-out section. As a result of these successive operations the material of the skin plate at the cut has the possibility to deflect outward.

It is possible to suffice with one cutting through operation, if the method is characterized by:

(7) the performing of step (3) such that the sharp end of the blade just cuts through the second skin plate.

As an alternative the method can be characterized by:

(8) the performing of step (3) such that the sharp end of the blade partially cuts through the second skin plate, and optionally, (9) the breaking apart of the second skin plate by bending along the formed cuts.

It will be apparent that the free zone, in particular the free zone made in wedge shape, ensures a very finely finished edge. Such a fine edge is not wholly certain on the side which is cut through only by the sharp end of the first knife. Should it be of importance that this side also has a finely finished edge, the method can then be characterized by:

(10) the forming in accordance with step (4) of like free zones on both sides of the panel.

Use can be made of a second and a separate third knife, but the method may also be characterized by:

(11) the successive use of only one knife as the second and the third knife.

The invention also relates to a device for making a cut in a sandwich panel consisting of a core and relatively thin and mechanically resistent skin plates adhered thereto on both sides. Such a device is adapted for performing the method as specified above and is characterized for this purpose by:

(1) means for carrying the panel, (2) means for carrying a first knife with a blade sufficiently long to make a cut in the panel, (3) means for setting into operation the first knife in relative position parallel to the main plane of the panel for making the cut in the panel along a preselected path.

(4) means for the forming of a free zone extending along the chosen path, in which zone the first skin plate to be directed to the knife is removed and which zone is at least as wide as the blade.

A preferred embodiment of this device according to the invention is characterized by:

(5) means for carrying a second and third knife with a blade of sufficient length for cutting at selected angles through the first skin plate to be directed to the first knife and for cutting into the core up to a chosen depth, and (6) means for successive setting into operation of the second and third knife parallel to the main plane of the panel along paths parallel to the chosen path, with a slanted positioning of the second and the third knife such that a wedge-shaped zone is cut out, of which the width on the transition between the core and the first skin plate corresponds with the width of the said free zone.

In order to ensure a very accurate positioning during the cutting of the second and the third knife, while use can nevertheless be made of a thin blade, the device preferably displays the feature that the second and the third knife have a cutting edge with one surface ground at an angle, which surface is directed outward during the cutting operation.

It can be advantageous if the device according to the invention is capable of forming the said free zones on both sides of a sandwich panel simultaneously. To this end the device is characterized by means for forming simultaneously in one passage two free zones extending mutually parallel on corresponding positions. Such a device has the advantage that the two free zones can be manufactured in one operating movement and that positioning and registering problems are avoided.

The said means can also be arranged for carrying the first knife, with the result that the forming of the two free zones in one passage is also followed by complete cutting through of the panel.

In a preferred embodiment the device is characterized by two carriers each with two knives, which carriers are coupled for simultaneous displacement.

It happens occasionally that the sandwich panels for working do not have a constant thickness over the whole surface. This can cause problems in the simultaneous forming of two free zones in one passage, as described above. When there is a constant mutual distance between the active knife points, lack of homogeneity in the thickness of the plate can cause a varying width in one of the free zones. This is not permissible for an accurate cut of high quality.

In order to solve this problem a variant can display the feature that the means for carrying the panel includes clamping means for clamp positioning of the panel, which clamping means includes two clamping plates to be moved towards one another with force by drive means, one of which plates is stiff and one resiliently flexible.

With a view to a permanently exact positioning the device can be advantageously characterized by a resiliently compressible layer, for instance a rubber layer, present on at least one of both clamping plates.

The invention will now be elucidated with reference to the annexed drawing, in which.

Figure 1:
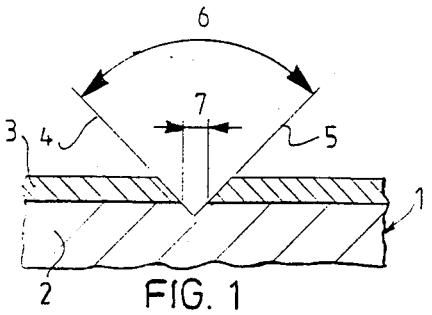
FIG. 1 shows a cross section through the upper portion of a sandwich panel from which a wedge-shaped zone has been cut.

FIG. 1 shows a sandwich panel 1 including a core 2 of foam material and an upper skin plate 3. By means of slantingly disposed cutting knives to be described hereinafter a wedge-shaped incision is made in the upper face of the panel 1 via planes designated with 4 and 5. The width of this wedge-shaped zone 6 corresponds on the transition between the core 2 and the upper skin plate 3 with a width designated with 7. This width is of importance with a view to the cutting through of panel 1 subsequent thereto.

Figure 2:
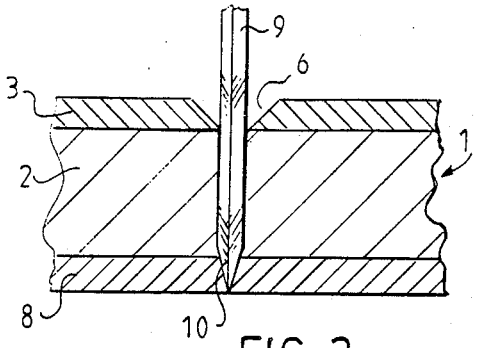
FIG. 2 shows the phase in which a knife cuts through the whole panel via the wedge-shaped free zone.

FIG. 2 shows the panel 1 more fully. In addition to an upper skin plate 3 it also comprises a lower skin plate 8 likewise affixed to the core 2. A knife 9 with a wedge-shaped cutting edge 10 is set in motion through the panel 1 via the wedge-shaped zone 6, this such that it does not touch the edges of this zone, that is, the opposite facing edges of the upper skin plate 3. This is the situation shown in FIG. 2.

Figure 3:
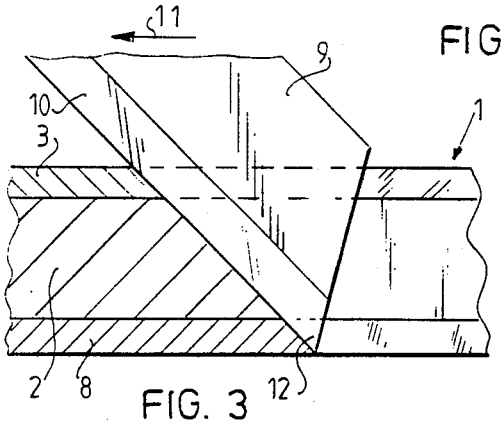
FIG. 3 is a view turned vertically through 90° of the situation as in FIG. 2.

The knife 9 is set in motion in the direction designated with 11 in the manner shown in FIG. 2 and FIG. 3, such that it cuts entirely through the core 2 and just touches the outer face of the lower skin plate 8 with the point 12 of the cutting edge 12. Thus ensured is that the sandwich panel 1 is cut completely through, while the forces exerted on the lower skin plate 8 nevertheless remain limited such that the arranged cut is usually of acceptable smoothness without there occurring any breaking off of material.

Should the bottom cut however not comply with the set quality requirements, a wedge-shaped zone 6 can be made on the top side as well as a wedge-shaped zone 6′ on the bottom side, as a result of which a completely smooth finish of the edges is ensured.

It will be apparent that in order to bring a panel to size a complete cut through from the one side to the other is required.

If desired a panel can be "pre-cut", which means that the operation shown in the FIGS. 2 and 3 is modified in the sense that the lower skin plate 8 is not cut through completely but only partially, which results in the panel being greatly weakened but still forming a mechanical unit. The lower skin plate can be broken later, for example by hand.

Figure 6:
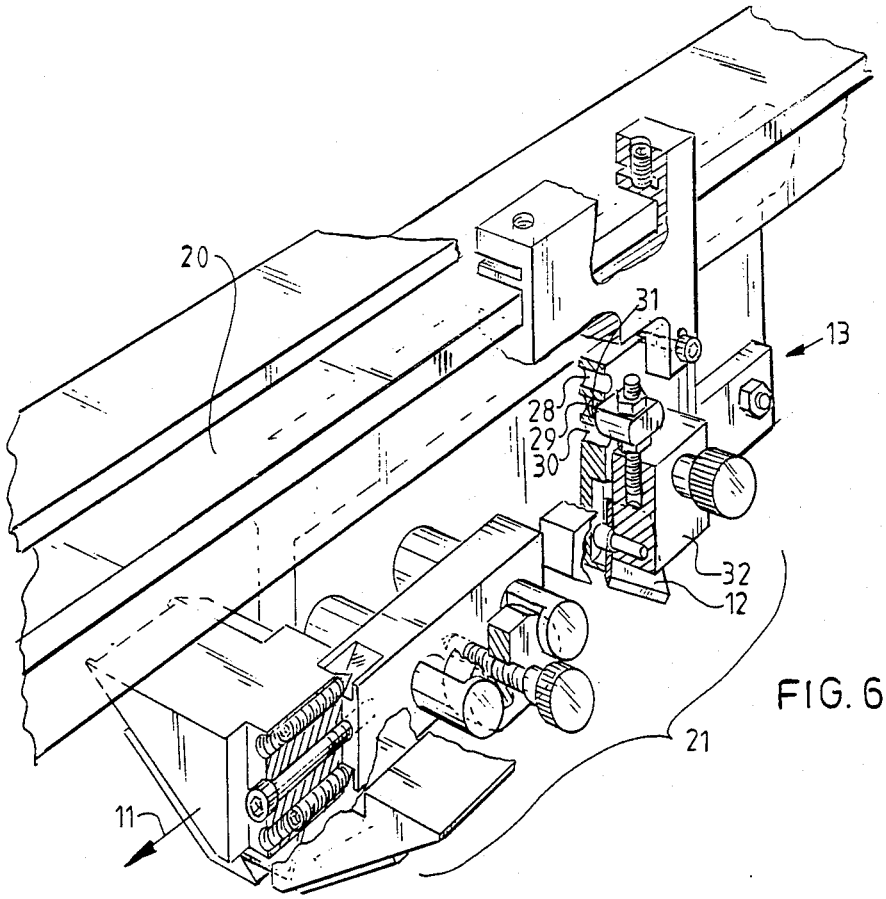
FIG. 6 shows a perspective, partly broken away view of the device as in FIG. 5, as seen obliquely from above.
Figure 5:
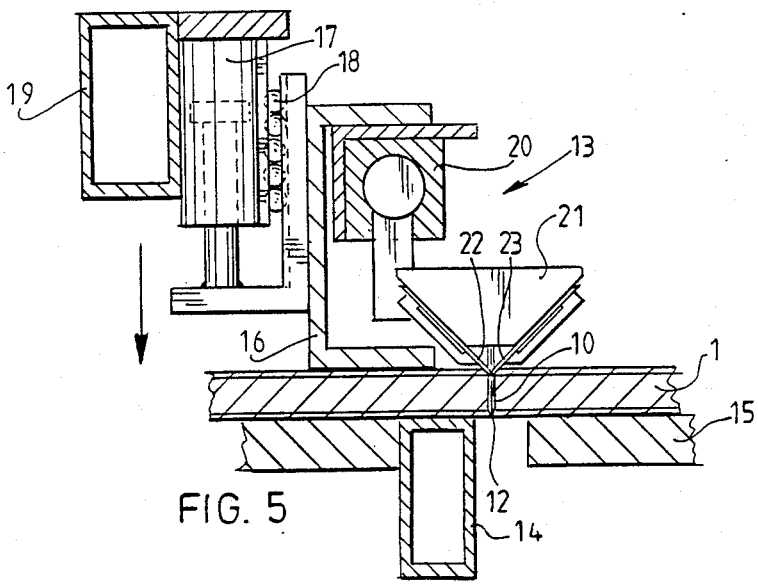
FIG. 5 is a cross sectional view of a device for performing the method shown schematically above in the FIGS. 1–3.
Figure 7:
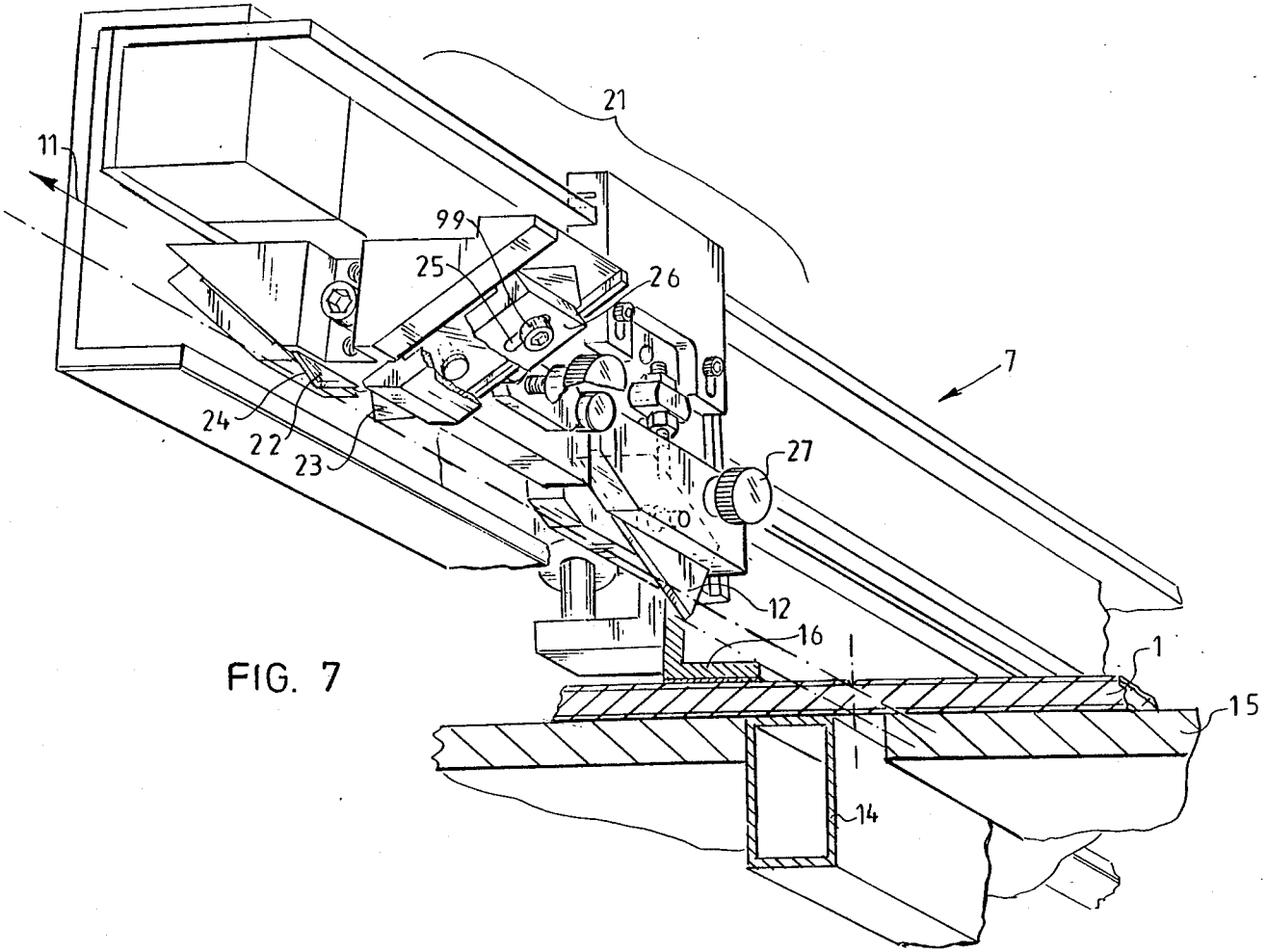
FIG. 7 shows the device as according to FIG. 5 in perspective, partly broken away view, as seen obliquely from below.

The FIGS. 5, 6 and 7 show a device 13 which can perform the above specified working on the sandwich panel 1.

In this device the sandwich panel 1 is carried by a table top 15 supported by a frame beam 14 and clamped in position relative thereto by means of a clamping beam 16. Via a clamping cylinder 17 with ball guide 18 this clamping bar is up and downwardly movable relative to a fixed upper frame beam 19 for clamping the sandwich panel 1 in place on the table top 15 by means of energising of the clamping cylinder 17.

The panel 1 is laid on the table top 15 of the device 12 and positioned at the correct cutting size by means of per se known means. Clamping then takes place in the above described manner.

The clamping beam 16 carries a cutter head 21 via a guide beam 20. This head serves to form the wedge-shaped zone 6 by means of two slantedly disposed knives 22, 23 and also bears the knife 12. Setting in motion of the cutter head 21 relative to the panel 1 takes place in the cutting direction designated with 11. The foremost knife 22 disposed at an angle of roughly 45° makes a first cut in the panel 1 which forms the left-hand edge of the wedge-shaped zone 6. At a distance behind, the knife 23, likewise disposed at a 45° angle but to the other side, forms the right-hand bounding edge of the wedge-shaped zone 6. The thus formed sliver of material is guided to a sufficient extent out of the path by the form of the cutting edge 24 of the knives 22, 23, with its one side ground at an angle, to enable cutting through of the panel by the knife 12 again placed at an interval behind, as described with reference to the FIGS. 1, 2 and 3.

As FIG. 7 shows the knives 22 and 23 each possess an elongate form with straight pointed ends each having two cutting sides ground on one side. This enables a regular interchanging of knives until all four cutting sides of both knives have become blunt.

By means of a clamping screw 99 and a slotted hole 25 in a clamping block 26 the knife 23 can be set to any desired cutting depth. It has in any case to be ensured that the wedge-shaped zone is cut out completely, which means that the main planes of the knives 22, 23 have to intersect. For cutting of a wider wedge-shaped zone 6 the choice of the height of the cutting head 21 has to be adapted in relation to the upper surface of the panel 1. It is noted that although not visible in FIG. 7 the knife 22 can also be fixed for adjustment within certain limits.

The knife 12 likewise has a height setting, this through use of a clamping screw 27.

In addition to this continually adjustable height setting of the knives 22, 23, 12 the cutting head 21 is also provided with a rapid-action adjustment for quick setting of different standard panel thicknesses. This rapid-action adjustment comprises three positioning holes 28, 29, 30 into which at choice a positioning pin 31 can be received which is connected to a block 32 forming part of the cutting head 21.

Figure 4:
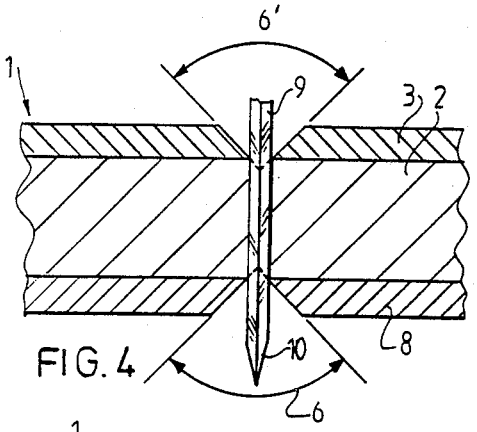
FIG. 4 is another embodiment in which a wedge-shaped zone is formed on both sides, through which zone the cutting knife can cut completely through the panel.

For the forming of a cut as according to FIG. 4, a wedge-shaped zone 6 can be initially cut out by the knives 22 and 23, whereby the knife 12 is placed in an inactive position. The thus cut panel 1 is then turned over, following which it is placed accurately in the correct position by means of the positioning means present and clamped in place. The cutting head is subsequently set in motion again for the forming of the second wedge-shaped zone 6' and simultaneous cutting through of the panel via the formed free zones. As indicated in FIG. 4, the height setting of knife 10 is then no longer critical.

Figure 8:
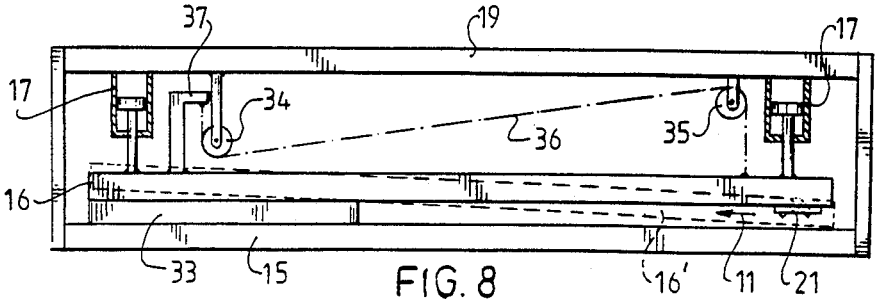
FIG. 8 is a highly schematic view of an arrangement, whereby a clamping beam is horizontally stabilised.

FIG. 8 shows in highly schematic manner the horizontal stabilising of the clamping beam 16 for the purpose of cutting small panels. Such a small panel is designated in FIG. 8 with 33. Through simultaneous energising of both clamping cylinders 17 the clamping beam would tend to assume the position indicated (in exaggerated manner) with 16'. In order to nevertheless ensure a homogeneous clamping of the panel 33, use is now made of two rollers 34, 35 connected to the upper frame beam 19, over which rollers is trained a chain, cord or cable which is connected on the left-hand side to a bracket 37 arranged on the clamping beam 16 and on the right-hand side to the clamping beam 16. As a result of this guiding with the stabilising cable 16 the tendency of the clamping beam 16 to assume a sloping position is eliminated, thus ensuring a homogeneous clamping over the whole active length of the beam, also in the case of smaller panels.

Figure 9:
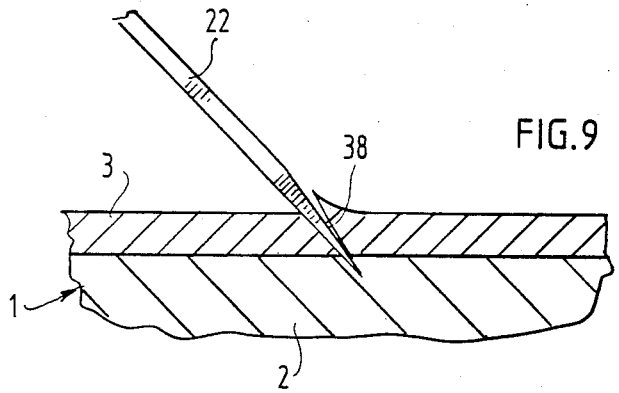
FIG. 9 shows a schematic cross section through a portion of a skin plate with a knife for forming a first cut.
Figure 10:
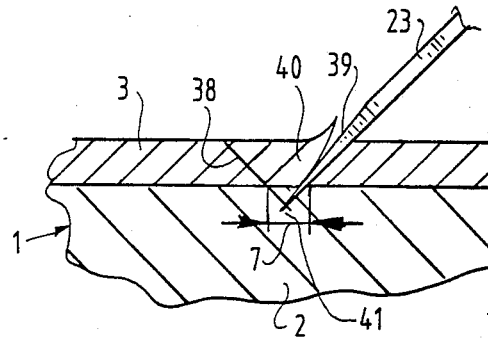
FIG. 10 is a view corresponding to FIG. 9 in a following operational phase in which a following knife forms a second cut.

The FIGS. 9 and 10 show the sandwich panel 1 with foam core 2 and upper skin plate 3. When set into operation in lengthwise direction the leading slanting knife 22 forms a slanting cut 38, as described above. On the top side or outside of this cut 38 the material of the skin plate 3 can deflect outwards. As a result the material does not tend to break off.

FIG. 10 shows the subsequent phase in which the rear slanting knife 23 forms an angled cut 39 positioned in relation to the cut 38 such that an elongate wedge 40 of the material of the skin plate 3 is cut off. As FIG. 10 shows, when the cut 39 is formed the cut 38 may be closed temporarily, as a result of which the skin plate material above the cut 39 can deflect, thus preventing here also the forming of an irregular edge.

As shown in FIG. 10 the cuts 38 and 39 display an overlapping zone 41. Because of the presence of the overlapping zone the wedge 40 is with certainty completely detached from the sandwich panel 1.

Figure 11:
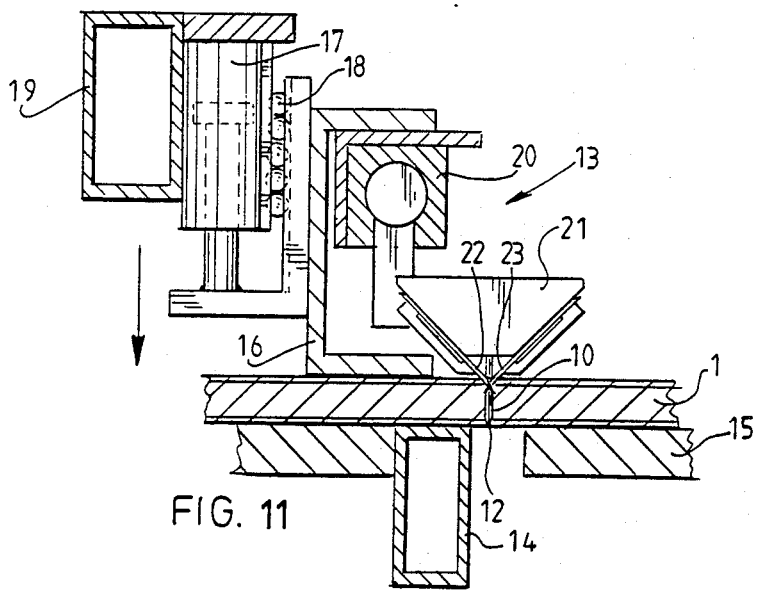
FIG. 11 is a view corresponding to FIG. 5 of a preferred embodiment.

FIG. 11 shows in general the same device as FIG. 5. In the embodiment of FIG. 11 however the knives 22 and 23 are positioned such that their active ends can form the overlapping zone 41 as according to FIG. 10.

Figure 12:
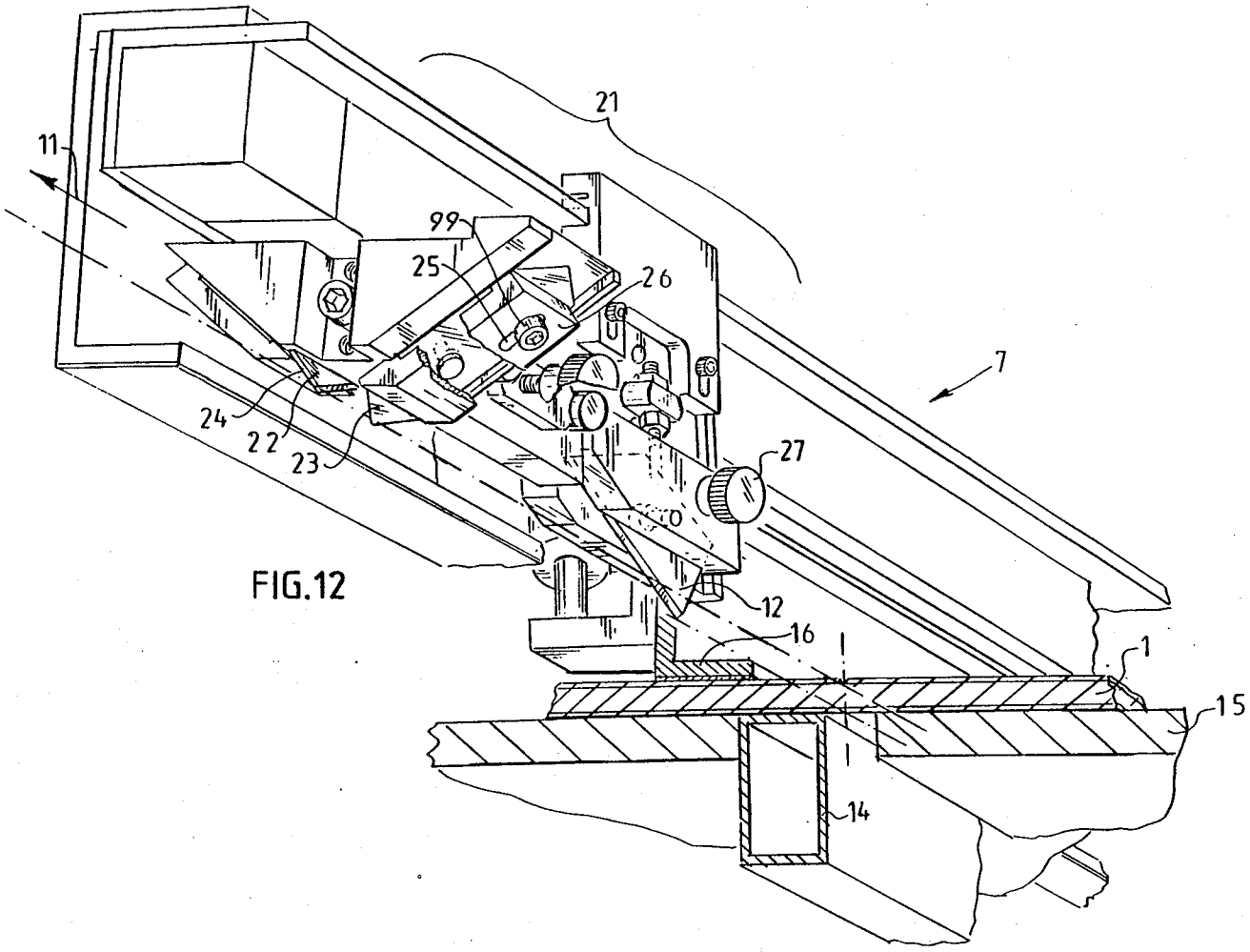
FIG. 12 shows a view corresponding to FIG. 7 of the variant as in FIG. 11.

FIG. 12 shows this same aspect in a view corresponding with FIG. 7.

Figure 13:
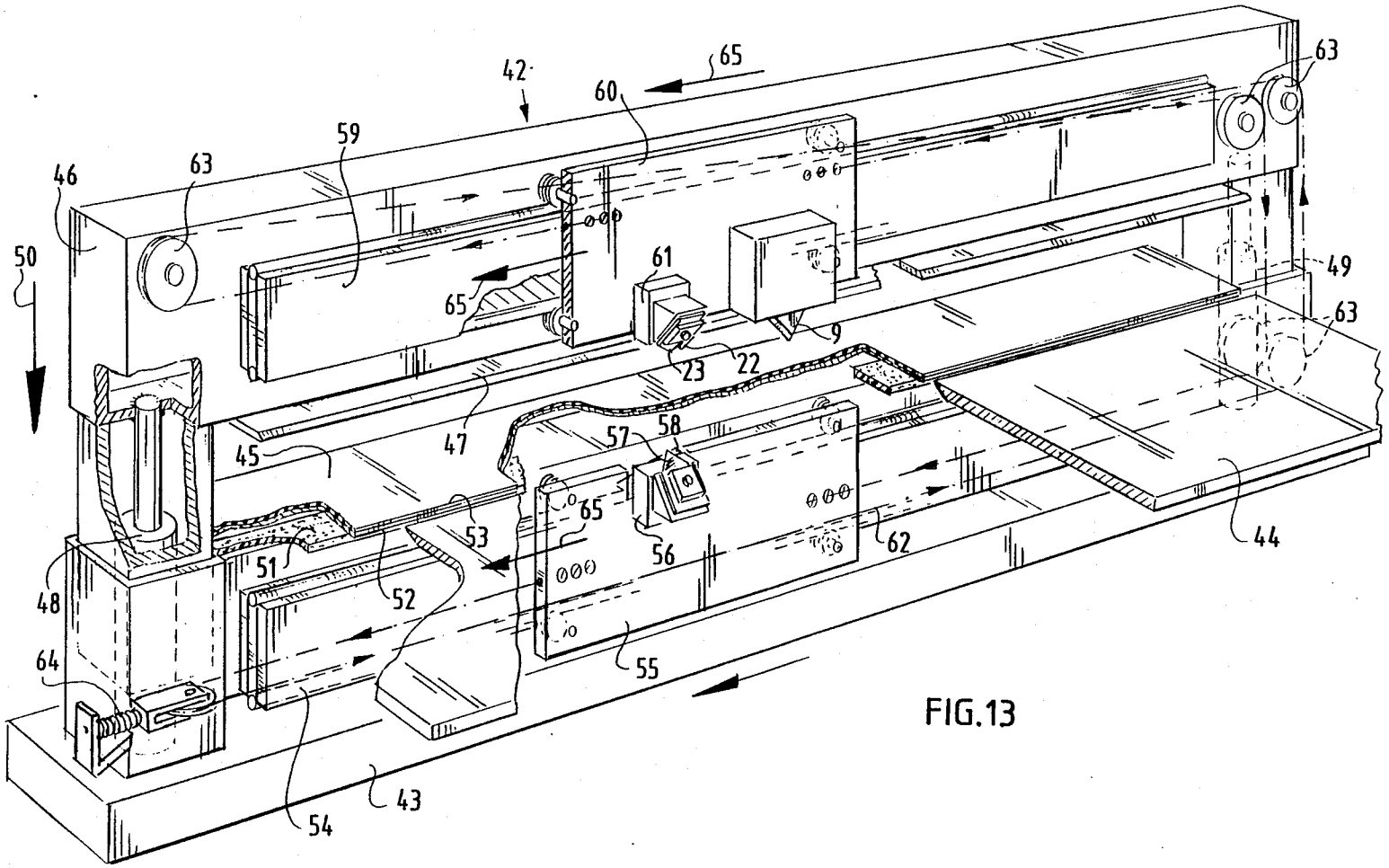
FIG. 13 is a partly broken away, perspective view of a device with which a wedge-shaped surface zone can be removed on both sides of a panel in one passage and the panel can be cut completely through between both zones.

FIG. 13 shows a device 42 for simultaneous forming in one passage of two free zones extending mutually parallel on corresponding positions on a sandwich panel. Such a panel is shown in FIG. 4.

The device 42 comprises a frame 43 having a clamping plate 45 connecting to a carrier plate 44. This lower clamping plate 45 will be further discussed hereinafter.

The frame 43 further bears an up and downward reciprocal auxiliary frame 46 which carries a stiff upper clamping plate 47 for fixing a sandwich panel together with the lower clamping plate 45. The auxiliary frame 46 can be moved downward with force by energising two cylinder-piston units 48, 49 by means of not drawn means. When these are energised the auxiliary frame 46 can be moved downward according to arrow 50, with the result that the clamping plates 45, 47 can together clamp a positioned sandwich panel.

The clamping plate 47 is carried by the frame 48 via a neoprene block 51 and itself includes a stainless steel resilient strip 52 to which is adhered a rubber covering layer 53. Through this construction the active upper surface of the lower clamping plate 45 can follow any variations in the thickness of the sandwich plate that may occur.

The frame 43 carries a guide rail 54 for slidable guiding of a carriage 55 which bears a knife holder 56 with knives 57, 58. The up and downward movable auxiliary frame 46 carries a guide rail 59 for guiding a carriage 60 which bears a knife holder 61 with the knives 22 and 23.

By means of a rope 62 which is trained over pulleys on the frame 43 and auxiliary frame 46 generally designated with 63, the carriages 55 and 60 are coupled to one another for simultaneous displacement. It will be apparent that in the active clamping position of the auxiliary frame 46 the rope 62 has to be tensioned. Use is made for this purpose of a rope tensioner in the frame 43 symbolically designated as a draw spring 64.

The knives 22, 23 and 57, 58 are positioned in the manner as described with reference to the FIGS. 9, 10 and 11. The points of the knives thus lie in staggered position in lengthwise direction. The knife holders 56 and 61 also lie in staggered position in lengthwise direction. Achieved as a result of this staggered relationship is that the knives 22, 23 could never come into undesired contact with the knives 57, 58 in the case where the cylinders 48, 49 are energised in the direction of arrow 50 without there being a sandwich panel for working placed in the device 42.

The carriage 60 further bears the through-cutting knife 9.

By displacing the carriages 55, 60 in lengthwise direction as according to arrows 65 a sandwich panel can be provided on both sides with cut out wedge-shaped zones and cut through in one operation.

The carriage 60 can if desired be displaced manually in the direction of arrow 65 and after working of the sandwich panel be returned once again to its right-hand starting position. If required motor means (not drawn) can also be present for the displacement of the carriages 55, 60. One or more of the rollers 63 may for instance be coupled to a motor.

It will be apparent that the carriage 55 has to be disposed such that it is capable of following variations in thickness of the sandwich panel for working.

I claim:

1. A method for making a cut in a sandwich panel having a core and first and second skin plates adhering to both sides of the core, comprising the steps of:

forming a channel in the panel by removing the first skin plate along a path for making the cut; and cutting the panel with a first cutting means having a blade by positioning the blade of the first cutting means in the channel and setting the blade in motion in the direction of the channel.

2. The method of claim 1 wherein the channel is formed by:

positioning second and third cutting means having blades sufficiently long to cut through the first skin plate, at selected angles with their respective blades pointing inward; and forming a wedge-shaped channel by setting the blades of the second and third cutting means into motion along paths piercing the first skin plate of the panel, the paths intersecting such that a wedge-shaped cut is made at least through the first skin plate.

3. The method of claim 1 wherein the blade of the first cutting means cuts through the core and through the second skin plate of the panel.

4. The method of claim 1 wherein the blade of the first cutting means cuts through the core and partially through the second skin plate of the panel, further comprising the step of breaking the second skin plate by bending the second skin plate along the partial cut.

5. The method of claim 1 or 2 further comprising the step of forming a second channel in the panel by removing the second skin plate along the path for making the cut.

6. The method of claim 5 wherein the second channel is formed by:

positioning fourth and fifth cutting means having blades sufficiently long to cut through the second skin plate, at selected angles with their respective blades pointing inward; and forming a wedge-shaped channel by setting the blades of the fourth and fifth cutting means into motion along paths piercing the second skin plate of the panel, the paths intersecting such that a wedge-shaped cut is made at least through the second skin plate.

7. The method of claim 2 wherein a single knife is used successively as the second cutting means and the third cutting means.

8. The method of claim 6 wherein a single knife is used successively as the fourth cutting means and the fifth cutting means.

9. A device for making a cut in a sandwich panel having a core and first and second skin plates adhered thereto, comprising:

means for forming a channel extending along a path for making a cut, by removing the first skin plate along the path for making a cut;

first cutting means having a blade sufficiently long to cut the sandwich panel to a desired depth;

means for positioning the blade of the first cutting means in the channel; and means for setting the blade of the first cutting means in motion in the direction of the channel to make the cut.

10. The device of claim 9 wherein the means for forming the channel comprises:

second and third cutting means having blades sufficiently long to cut through the first skin plate;

means for positioning the second and third cutting means at selected angles with their respective blades pointed inward; and means for setting the blades of the second and third cutting means in motion along paths piercing the first skin plate of the panel, the paths intersecting such that a wedge-shaped cut is made through the first skin plate.

11. The device of claim 10 wherein the blades of the second and third cutting means each comprise a cutting edge having one surface ground at an angle, and wherein said ground surfaces are directed outward from each other during cutting.

12. The device of claim 9 comprising means for forming at least two channels simultaneously on exactly opposite sides of the panel.

13. The device of claim 12 wherein the means for forming at least two channels comprises two knife carrying means, each knife carrying means comprising a knife holder mounted to a movable carriage, each knife holder having two cutting knives mounted thereto; and means for coupling the two knife carrying means for simultaneous displacement of the cutting knives in the direction of the channels.

14. The device of claim 13 further comprising means for carrying the sandwich panel, said panel carrying means including clamping means comprising a stiff clamping plate mounted to an upper frame, a flexible clamping plate mounted to a lower frame, two telescoping piston units engaging the upper frame to the lower frame, and means for energizing the piston units to cause the upper and lower frames to move toward one another thereby securing the panel between the clamping plates.

15. The device of claim 14 further comprising a compressible layer located on at least one of the clamping plates.

16. The device of claim 15 wherein the compressible layer comprises rubber.

* * * * *